United States Patent [19]

Adachi et al.

[11] Patent Number: 4,514,965

[45] Date of Patent: May 7, 1985

[54] APPARATUS FOR CONTINUOUSLY PACKING MEDICAL APPLIANCES FOR STERILIZATION

[75] Inventors: Kiyoshi Adachi, Otake; Masaru Uehara, Komaki; Hiroshi Kitagawa, Nagoya; Hirotaka Kojima, Kasugai; Masaaki Sato, Nagoya, all of Japan

[73] Assignee: Mitsubishi Rayon Company, Limited, Tokyo, Japan

[21] Appl. No.: 483,108

[22] Filed: Apr. 8, 1983

Related U.S. Application Data

[62] Division of Ser. No. 207,900, Nov. 18, 1980, abandoned.

[30] Foreign Application Priority Data

Nov. 19, 1979 [JP] Japan ..... 54-149702
Nov. 19, 1979 [JP] Japan ..... 54-149703
Nov. 19, 1979 [JP] Japan ..... 54-149704

[51] Int. Cl.[3] ..... B65B 9/10
[52] U.S. Cl. ..... 53/553
[58] Field of Search ..... 53/553, 554, 547, 548, 53/550, 551, 410, 450, 449, 479

[56] References Cited

U.S. PATENT DOCUMENTS 2,208,951 7/1940 Tamassy ..... 53/554 X
3,338,023 8/1967 Lazenby ..... 53/553 X
3,357,151 12/1967 Monaghan ..... 53/553 X
4,355,494 10/1982 Tilman ..... 53/551 X
4,437,853 3/1984 Metz ..... 53/551 X

FOREIGN PATENT DOCUMENTS 460215 9/1975 U.S.S.R. ..... 53/554

*Primary Examiner*—Horace M. Culver
*Attorney, Agent, or Firm*—Oblon, Fisher, Spivak, McClelland & Maier

[57] ABSTRACT

Medical appliances are continuously packed for sterilization thereof by the process wherein (1) bags having micropores in peripheral side portions thereof to be sealed, which micropores allow passage of a sterilizing gas and a high pressure steam but do not allow passage of germs, are formed from packing sheets; (2) medical appliances are inserted into the bags while the bags are formed; (3) all the peripheral side portions of the bags are sealed; and (4) the sealed bags containing the packed medical appliances are separated into packages each having the packed medical appliance.

3 Claims, 3 Drawing Figures

APPARATUS FOR CONTINUOUSLY PACKING MEDICAL APPLIANCES FOR STERILIZATION

This is a division of application Ser. No. 207,900, filed Nov. 18, 1980, and now abandoned.

BACKGROUND OF THE INVENTION

1. Field of the Invention

The present invention relates to an apparatus for continuously packing medical appliances which are to be sterilized in the packed state.

2. Description of the Prior Art

Various medical appliances and supplies used in hospitals (generally referred to as "medical appliances" hereinafter) are subjected to sterilizing treatments such as high pressure steam sterilization, ethylene oxide gas (EOG) sterilization, radiation sterilization and dry-heating sterilization before they are used in medical treatments. Of these the former two sterilizing treatments are commonly adopted. The sterilized medical appliances are kept in a sealed state until they are used in medical treatments, so as to avoid the risk of re-contamination with germs.

For such sterilizing treatment, there is ordinarily adopted a method in which individual medical appliances are inserted in to bags (hereinafter referred to as "sterilizing bags") and then they are sterilized in this state. The sterilizing bags are comprised of cellulose paper or of cellulose paper and a plastic film. Furthermore, sterilizing bags comprised of a synthetic pulp paper or a non-woven fabric are also used in some cases.

However, the operation of inserting and enclosing medical appliances in sterilizing bags is performed manually. That is, respective medical appliances are inserted into sterilizing bags, and then the opening of each bag is closed by pasting, heat sealing or the like. This method is troublesome and unhygienic and, thus, not preferable as the method for packing medical appliances for sterilization.

In the process for continuously packing articles, which is ordinarily adopted at the present, a thermoplastic film, a paper or plastic film having a thermoplastic material laminated or coated on the inner side thereof, a thermoplastic fiber-mixed paper or a synthetic pulp-mixed paper is used as the packing material. This packing material is folded into two or three to form a pouch, three sides of the pouch are sealed and thereafter an article is packed into the pouch.

A three sided-sealed pouch of a thermoplastic film or a paper having a thermoplastic material laminated or coated on the inner side thereof has an extremely poor air permeability, and no good sterilizing effect can be attained by EOG or high pressure steam sterilization. A thermoplastic fiber-mixed paper or synthetic pulp-mixed paper exhibits a good air permeability, but since it is poor in heat resistance, it cannot be subjected to high pressure steam sterilization treatment where it is exposed to a high temperature. Furthermore, in a pouch of such mixed paper having a much lower denisty than that of a cellulose type pulp paper there is danger of contamination with germs after sterilization.

SUMMARY OF THE INVENTION

It is a primary object of the present invention to provide a process for continuously packing medical appliances where by the medical appliances can continuously be packed efficiently and hygienically, and both sterilization and prevention of re-contamination with germs after sterilization can be attained in the packed medical appliances with high reliability.

Other objects and advantages of the present invention will be apparent from the following description.

In accordance with the present invention, there is provided a process for continuously packing medical appliances for sterilization thereof, which comprises forming bags from packing sheets, said bags having peripheral side portions to be sealed which portions have micropores allowing passage of a sterilizing gas and a high pressure steam but not allowing passage of germs, inserting medical appliances into the bags while the bags are being formed, sealing all the peripheral side portions of the bags, and separating the sealed bags containing the packed medical appliances into packages each containing the packed medical appliance.

DESCRIPTION OF THE PREFERRED EMBODIMENTS

Figure 1:
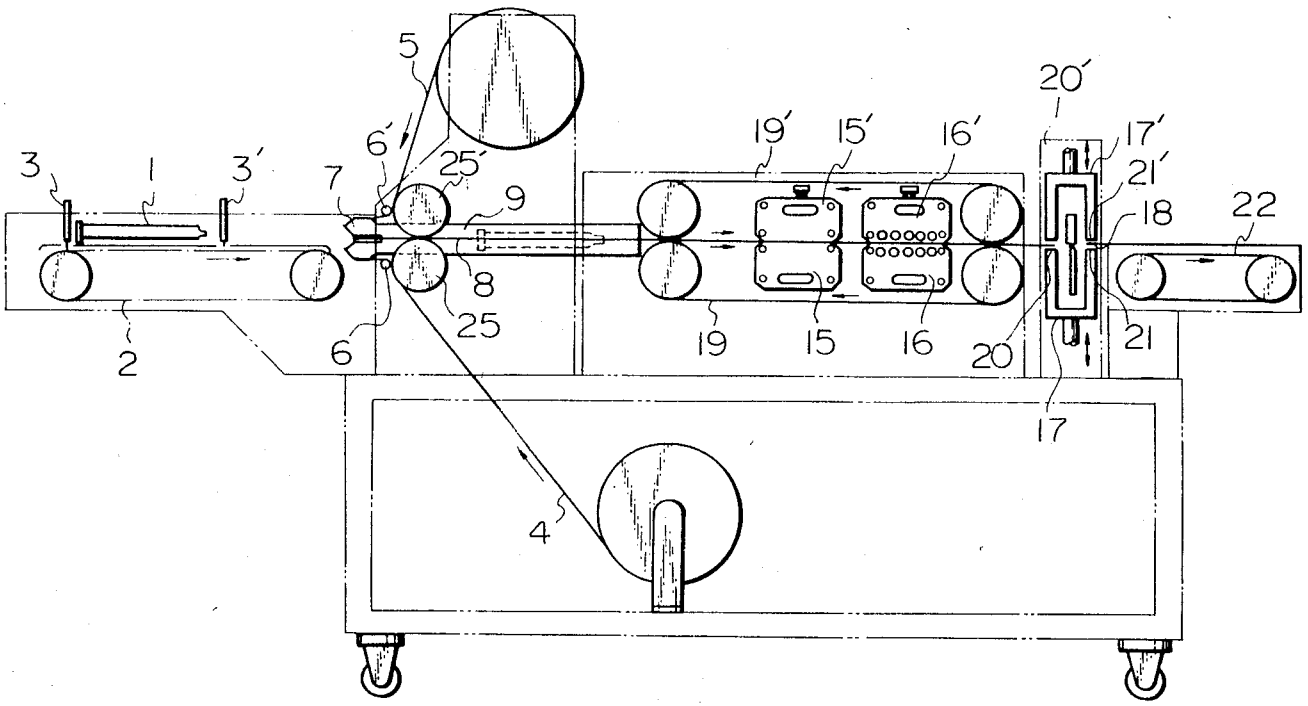
FIG. 1 is a side view showing the entire structure of one embodiment of the automatic packing apparatus that is used in carrying out the present invention.

The first characteristic feature of the present invention is formation of bags from packing sheets, films or other packing materials in which an air-permeable layer allowing free passage of a sterilizing gas such as EOG or high pressure steam and thereby enabling sterilization but not allowing intrusion of germs after the sterilization treatment is formed at least in the peripheral side portions to be sealed. The packing sheets, films or other packing materials used in the present invention are hereinafter referred to as "packing sheets" for brevity.

The structure of the packing sheets to be formed into a bag and the process for the preparation of bags will now be specifically described.

Sealing of peripheral side portions in automatic continuous packing is ordinarily performed by so-called heat-sealing of a thermoplastic resin or a film thereof, and this method is most efficient.

In the present invention, sealing is performed according to this heat sealing method unless otherwise indicated. If at least one of two confronting sheets to be bonded is thermoplastic, heat sealing of peripheral sides is possible. A paper comprised of a cellulose pulp or synthetic pulp, or a thermoplastic or non-thermoplastic film is coated with a thermoplastic resin having a melting point lower than that of the above film but higher than the sterilizing temperature, or laminated with a film of such thermoplastic resin, (the coated or laminated thermoplastic resin component will be called "melting component" hereinafter).

Coating or lamination may be performed by any conventional method. A long roll of the coated or laminated composite sheet having a predetermined width (in the present invention, the packing sheet is supplied in the form of a long roll having a predetermined width, and when two packing sheets are used, rolls of these packing sheets are substantially equal in the width unless otherwise indicated) is taken out in such a manner that the melting component is located on the inner side, together with a long roll of a separately prepared packing sheet which is formed so that the sealing section to be formed by heat sealing has an air permeability, and both the side edges are heat-sealed at a temperature higher than the melting point of the melting component to form a cylinder (these seals formed on the side edge portions parallel to the direction of advance are hereinafter referred to as "side seals" for brevity). Medical appliances to be sterilized are inserted into the cylinder. A second type of seals (they are ordinarily called "end seal" and "top seal") are simultaneously or sequentially formed in directions rectangular to the direction of advance. The above operations are continuously conducted, and medical appliances packed between every two adjacent top seals, respectively, are separated by cutting the respective top seal portions.

One preferred embodiment of the present inventon using a bag having both the upper and lower faces comprised of a plastic film will now be described.

Conventional sterilizing bags composed mainly of a cellulose pulp (inclusive of bags having one face comprised of a cellulosic paper and the other face comprised of a thermoplastic film) are not satisfactory in maintaining the sterilized state after sterilization because the cellulose pulp has insufficient heat resistance, water resistance and mechanical strength. Accordingly, care must be taken in handling and it is difficult to maintain the sterilized state for a long time after sterilization. As means for overcoming these disadvantages, a sterilizing bag formed from a heat-resistant thermoplastic film instead of the cellulose pulp has been proposed. However, the air permeability of a plastic film is substantially zero and thus, it is impossible to sterilize medical appliances packed in a plastic film bag.

Realizing the above mentioned, we previously proposed a sterilizing bag comprising a fibrous sheet inserted into the heat-sealing section on the peripheral side portions of the bag formed from plastic sheets, in which EOG or high pressure steam in allowed to pass through the layer of this fibrous sheet (see Japanese Laid-Open patent application No. 26189/79 and Japanese Laid-Open Utility Model application No. 52894/79). More specifically, we found that, when bags are formed by piling a composite sheet comprised of a plastic film and a non-woven fabric laminated on the plastic film, with a composite sheet comprised of a plastic film and a thermoplastic resin having a melting point lower than that of the plastic film, which resin is coated or laminated on the plastic film, in such a manner that the non-woven fabric layer and the melting component layer are located on the inner side, and then, heat-sealing the piled assembly at a temperature higher than the melting point of the melting component and, when medical appliances are enclosed in these bags and sterilized, the sterilization can be accomplished at a high efficiency and the sterilized state can be maintained for a long time.

In accordance with one preferred embodiment of the present invention, a composite sheet comprised of a plastic film and a fibrous sheet which is laminated on and integrated with the plastic film and a composite sheet comprised of a plastic film coated or laminated with a thermoplastic resin having a melting point lower than that of the plastic film are used as the packing sheets, and automatic continuous packing is carried out by using these composite sheets according to the above-mentioned method. According to an improved modification of this embodiment, two composite sheets each comprised of a plastic film coated or laminated with a low melting point thermoplastic resin on one face are piled so that the melt component layers confront each other and both the side edge portions parallel to the direction of advance, of one sheet are registered with both the side edge portions parallel to the direction of advance, of the other sheet, the two composite sheets are simultaneously taken out in this piled state, heat-sealing is performed while tapes of a fibrous sheet each having a width larger than the width of the heat seal portion to be formed on each of the side edge portions is continuously supplied between the side edge portions of the upper and lower films synchronously with the movement of the films and side seals are formed in the state where the fibrous sheet is sandwiched.

Any papers, non-woven fabrics, knitted fabrics and woven fabrics having a section provided with an air permeability necessary for sterilization and a germ-filtering capacity necessary for maintenance of the sterilized state after sterilization can be used as the above-mentioned fibrous sheet. However, a fibrous sheet having through-holes extending over the entire thickness, such as proposed in Japanese Laid-Open patent application No. 26190/79, is preferably used, and a fibrous sheet comprised of cellulose type fibers and thermoplastic polymer fibers in which the content of the thermoplastic polymer fibers is 10 to 80% by weight is preferable. In the portion heat-sealed through such a fibrous sheet comprising 10 to 80% by weight of thermoplastic polymer fibers, undesirable fluffing of the fibrous layer is minimized or avoided by the local fusion bonding of the thermoplastic polymer fibers when the bag is opened in order to use a sterilized medical appliance, and the opening operation can be performed very smoothly. If the content of the thermoplastic polymer fibers exceeds 80% by weight, air-permeating through-holes (spaces among fibers) are liable to be clogged by the melting of the fibers at the heat-sealing step and the air permeability is reduced.

The width of the seal to be formed is usually at least 2 mm, preferably at least 5 mm. When the width is smaller than 2 mm, the density of the fibrous sheet must be extremely increased for maintenance of the sterilized state, with the result that the air permeability is reduced and the sterilization efficiency is lowered.

It is preferable that a non-woven fabric having an apparent density of not more than 0.7 g/cm $^3$ be used as the fibrous sheet in the present invention. When a non-woven fabric having an apparent density of more than 0.7 g/cm$^3$ is used, the air permeability through the sealing section is reduced and sterilization becomes impossible.

The foregoing enclosing methods are directed to embodiments where four peripheral sides of a bag are sealed. According to another embodiment of the present invention, medical appliances are enclosed into a cylindrical guide while the cylindrical guide is being formed, and in this embodiment, the quantity of the packing sheets necessary for packing and enclosing medical appliances can be reduced to a minimum level. Cylindrical guides may be formed according to any known method. In the present invention, it is preferable to adopt a method in which two packing sheets are used and a cylindrical guide is formed at a high efficiency by using a packing apparatus. This method will now be described.

When packing is performed by using two sheets, four sides should be sealed, and if a three-dimensional article having a substantial thickness is packed, it is generally difficult to make the inner pack sizes of the two sheets equal to each other in the end seal portion, and thus, wrinkles are inevitably formed in the end seal portions of one of the two sheets. Therefore, complete end seal cannot be formed. For this reason, automatic four-side sealing packing of three-dimensional articles with two sheets has not yet been developed.

According to the method preferably adopted in carrying out the present invention, a cylindrical guide having slits extending in the axial direction of the cylindrical guide, where the cylindrical guide can be divided into upper and lower symmetric parts is used. A sheet-introducing portion provided with slit-like openings communicated with said slits of the cylindrical guide and outwardly spreading while keeping the same space as that of the slits of the cylindrical guide is formed on one end of the cylindrical guide. Two packing sheets having a width larger than ½ of the length of the inner circumference of the cylindrical guide is fed to the sheet-introducing portion of the cylindrical guide under tension to impart a cylindrical shape to the packing sheets, and the flat side portions of the sheets coming from said slits of the cylindrical guide are lapped and continuously sealed and bonded to form side seals. When the thus obtained cylinder having a circular, square or oval section is end-sealed, a four side-sealed pouch having no wrinkles formed in the end seal portions can be stably formed.

The first characteristic feature of this method resides in that on one end of the cylindrical guide having slits extending in the longitudinal direction of the cylinder, where the cylinder can be divided into upper and lower symmetric parts, that is, on the packing sheet-introducing end portion of the cylindrical guide, a sheet-introducing portion provided with a pair of slit-like openings communicated with the slits of the cylindrical guide and outwardly spreadingly flatly while keeping the same space as that of the slits is formed. Two packing sheets having a width larger than ½ of the length of the inner circumference of the cylinder are supplied under tension to the sheet-introducing portion of the cylindrical guide to impart a cylindrical shape to the packing sheets, the two sheets are piled together in the portions of the two-slit-like openings, the piled portions are continuously sealed and integrated, and lapped portions, that is, side seal portions, are formed while keeping a cylindrical shape in the packing sheets.

Accordingly, it is preferable that the piled side portions coming out from the slit-like openings be processed by a side sealer in the state where the piled portions are held by the cylindrical guide. For realizing this feature, said sheet-introducing end portion is communicated with a part of the cylindrical guide, along the slits extending in the longitudinal direction of the cylindrical guide, from the top end of the sheet-introducing portion of the cylindrical guide. The flat portions defining the slit-like openings may be of an optional length along the longitudinal direction of the slits formed on the cylindrical guide.

In each of the slit-like openings, it is sufficient if the openings are defined by the parallel confronting flat faces. For example, the slit-like openings may be formed by locating two flat plates so that they confront each other, or by increasing the wall thickness of the top end portion of the cylinder.

The second characteristic feature of the above-mentioned method resides in that the cylindrical guide is caused to act as a pair of symmetric confronting tunnel-shaped guides, whereby the inner pack sizes of the end seal portions of the two sheets supplied to and passed through the respective cylindrical guides are made equal to each other. This feature is realized by using a cylindrical guide which is divided into upper and lower symmetric parts. In addition, it is indispensable that the packing sheets are passed through the cylindrical guide in the state of being brought into contact with the inner wall of the cylindrical guide.

Close contact of the sheets to the inner wall of the cylindrical guide is attained by turning the sheets over under tension at the introducing end of the cylindrical guide. It is preferable that slopes inclined at an acute angle ($\theta$ in FIG. 2) of smaller than 90° but not smaller than 5° be formed on the introducing end of the cylindrical guide. When the sheets are supplied so that the sheets are brought into close contact with such introducing end, the sheets can be turned over and brough close to the inner wall of the guide very smoothly.

If notched openings sinking from the top end of the introducing portion of the cylindrical guide toward the respective slits are formed in the introducing portion of the cylindrical guide, the packing sheets are smoothly guided into the cylindrical guide and formation of wrinkles and other defects on the packing sheets are prevented.

The third characteristic feature of the above-mentioned method resides in that a cylindrical shape is given to packing sheets by a cylindrical guide having slits where the cylindrical guide can be divided into upper and lower symmetric parts and simultaneously, medical appliances to be packed are inserted into the sheets formed into a cylinder, and that top seals are formed at predetermined intervals and the medical appliances enclosed in the thus formed bags having the entire periphery sealed are continuously withdrawn one by one.

The method of the present invention is carried out preferably by using a continuous packing apparatus comprising an introduction mechanism for introducing medical appliances to be sterilized, a mechanism for supplying packing sheets, an enclosing mechanism for enclosing the appliances with the packing sheets in the state where the appliances are inserted between the packing sheets, a sealing mechanism including a side sealer for sealing the sides of the packing sheets enclosing the medical appliances therein and a top sealer for sealing the end portions in the longitudinal direction, a cutting mechanism for cutting the sealed bags, and a withdrawal mechanism for withdrawing the packed medical appliances.

The method of the present invention will now be described more specifically with reference to the accompanying drawings.

In the apparatus shown in FIG. 1, the introduction mechanism comprises a feed conveyor 2 for feeding a medical appliance 1 to be sterilized and separate guides 3 and 3' mounted on the conveyor 2 at certain intervals determined according to the size of the medical appliance 1 on the conveyor 2. The medical appliance 1 to be sterilized, which is placed on the feed conveyor 2, is fed to the enclosing mechanism including a cylindrical guide by the movement of the conveyor 2. Separate guides are preferably disposed when appliances having a heavy weight are supplied or transfer of appliances must be performed perfectly. If these separate guides are used, deviation of the appliance from the predetermined position during transfer can be prevented and the appliance can be fed to the enclosing mechanism perfectly by the pressing force of the separate guides. The separate guides may be arranged so that they are allowed to fall down at the turning point of the conveyor 2, or the height of the separate guides may be adjusted according to the distance between the conveyor 2 and the enclosing mechanism. The enclosing mechanism performs an operation of wrapping the medical appliance 1 with packing sheets as the preliminary operation for sealing the medical appliance 1 to be sterilized. Packing sheets 4 and 5 wound in the form of tapes in long rolls, are guided to a packing sheet-introducing portion 7 through pressing guides 6 and 6', and they are formed into bags each containing the medical appliance 1 inserted therein. It is sufficient if the enclosing mechanism provides the function of enclosing the medical appliance with the packing sheets and the medical appliance to be sterilized is combined with the packing sheets by any optional means.

However, the quality of the seal formed at the subsequent step is influenced by whether the medical appliance 1 is enclosed in a good condition or in a bad condition. A three-dimensional medical appliance is usually enclosed in a sterilizing bag, and in this case, it is very difficult to precisely register the portions, to be sealed, of the packing sheets with each other. Especially when a composite sheet comprising a plastic film laminated on the non-woven fabric is used as the packing sheets, the seal of the sealed portion often becomes incomplete and a fear of re-contamination with germs after sterilization arises, with the result that continuous packing of medical appliances cannot be performed advantageously. Even when a three-dimensional medical appliance 1 is enclosed, this disadvantage is eliminated and the periphery is sealed perfectly with ease, if a specific shape is given to the enclosing mechanism.

Figure 2:
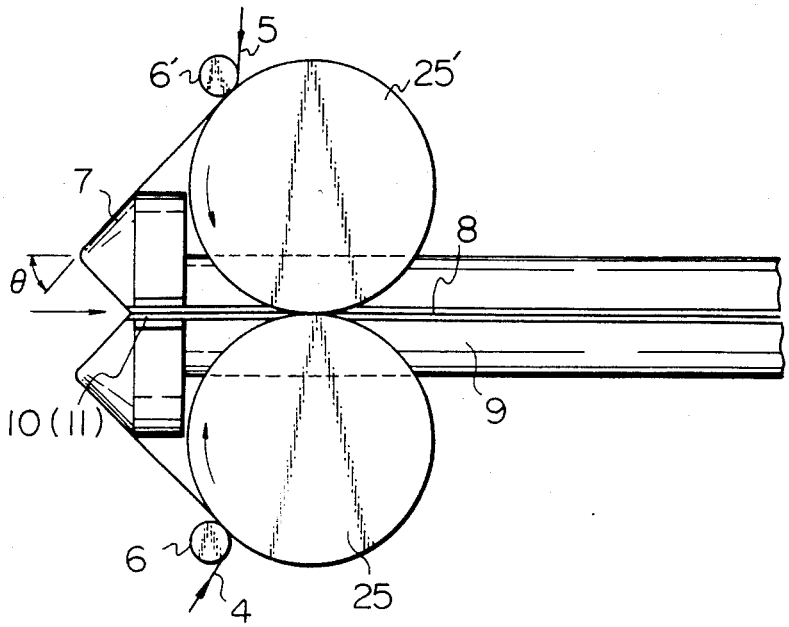
FIG. 2 is a side view showing an example of a cylinderical guide with a means of enclosing medical appliances; and, FIG. 3 is a perspective view showing the cylindrical guide shown in FIG. 2.
Figure 3:
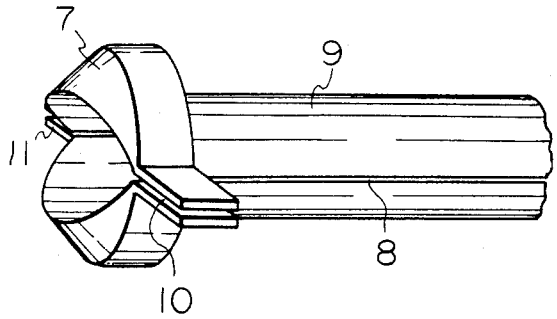

Referring to FIG. 2, the packing sheet-introducing portion 7 has slopes which are inclined at an acute angle ($\theta$) of smaller than 90° but not smaller than 5° so that the sheets 4 and 5 introduced to the top end of a cylinder 9 having slits 8 are smoothly turned over, and further has and a pair of slit-like openings 10 and 11 communicated with the slits 8 and spreading to the left and right wings perpendicular to the direction of advance while keeping the same space as that of the slits 8. The packing sheets 4 and 5 are introduced in the openings 10 and 11 of the packing sheet-introducing portion 7 through tension bars 6 and 6', respectively, and while the sheets 4 and 5 are being turned over by the slopes, they are piled together (the melting component layers should always be located on the confronting inner side) by the slits 8 and flat slit-like openings 10 and 11 in the state where the sheets 4 and 5 are in close contact with the inner wall of the cylindrical guide. Then, the sheets 4 and 5 are passed through driving rolls 25 and 25' and guided to heaters 15 and 15', as shown in FIG. 1. The sheets 4 and 5 are pressed during heating by guide tapes 19 and 19' whereby the sheets 4 and 5 are side-sealed to form a cylinder.

A method may be adopted in which heating press rolls are used as the driving rolls 25 and 25' and the sheets are side-sealed by these rolls. Furthermore, the heaters 15 and 15' may be located on the side faces of the cylindrical guide 9 of the sheet-introducing portion 7.

Medical appliances 1 to be packed, which are placed on the feed conveyor 2 preferably provided with separate guides 3 and 3', are introduced at predetermined intervals into the opening of the sheet-introducing portion, while the above-mentioned operations for sealing the packing sheets 4 and 5 are conducted.

The medical appliances enclosed in the packing sheets within the cylindrical guide are guided to top sealers 17 and 17' where top seals are formed by guillotine type heaters making a vertical movement intermittently or a rotary heaters attached at predetermined intervals on a rotary member. Simultaneously or subsequently, the packing sheets are cut between the top seals by a cutter 18 such as a guillotine cutter or rotary cutter and withdrawn by a conveyor 22. Pairs of impulse sealers 20 and 20' and 21 and 21' may be disposed upstream to and downstream from the cutter 18 so that both the ends of the cut portions are sealed simultaneously with cutting.

In the method of the present invention, the heat-sealing method is not particularly critical, and any of heat-sealing methods such as a hot pressing method or an impulse sealing method may be adopted. Furthermore, the shape of the heat-sealing means is not particularly critical so long as the continuous operation is possible.

It is indispensable that the cycle of feeding of medical appliances to be packed should be completely equal to the cycle of formation of top seals. For this purpose, gears, limit switches or phototubes may be used.

When top seals are formed by intermittent motions, it is preferable that side seals also be formed by intermittent motions. In this case, actuation and stopping of the side seal-forming heater are preferably performed by adjusting the heating temperature or pressing pressure.

The packing sheets before formation of top seals have a cylindrical shape. In order to form top seals stably while preventing insufficient sealing owing to wrinkles or darts, it is preferable that a chuck type stretching mechanism be disposed to stretch the sides prior to formation of top seals to render the cylindrical shape flat.

According to the above-mentioned method, by using a specially designed guide for the introduction of packing sheets, automatic continuous packing of three-dimensional medical appliances with two packing sheets becomes possible.

In this packing method, a sheet having a width larger than the sum of $\frac{1}{2}$ of the length of the inner circumference of the cylindrical guide and the seal width is used as the packing sheet. More specifically, it is indispensable that the width of the packing seal should be larger than or equal to the sum of $\frac{1}{2}$ of the length of the inner circumference of the cylindrical guide, the wall thickness of the cylindrical guide and the widths of both the side seal portions.

The upper limit of the width of the packing sheet is determined in view of facility of passage through the respective steps and the size and shape of the final packed medical appliance and also from the economical viewpoint.

Another embodiment of the method in which a composite sheet comprising a plastic film and a fibrous sheet laminated thereon is used and the fibrous sheet is interposed in the sealing sections on the four peripheral side portions will now be described. A three-layer composite sheet formed by extruding and laminating a thermoplastic resin between a non-woven fabric having regularly arranged open holes piercing through the wall thickness and a plastic film, said thermoplastic resin having a melting point lower than that of the plastic films, is used as the packing sheet and the composite sheet is continuously folded in two by an optional fold former so that the non-woven fabric layer is located on the inner side. The folded sheet is heat-sealed at a temperature higher than the melting point of the thermoplastic resin but lower than the melting point of the plastic film, whereby both the upper and lower films of the folded sheet are bonded through the fibrous layer by fusion bonding of the thermoplastic resin through the open holes of the non-woven fabric to form a bag.

According to still another embodiment, a plastic film containing a melting component layer is used as the packing sheet and is folded in two by a fold former so that the melting component layer is located on the inner side, and a fibrous sheet having a width larger than the heat seal width is continuously inserted between the two lap portions of the folded film to be heat-sealed synchronously with the movement of the plastic film and the lap portions are heat-sealed, whereby bags having the fibrous layer interposed in the side seal sections and parts of the top seal sections are formed.

When the above-mentioned non-woven fabric having open holes piercing through the wall thickness thereof is used as the fibrous sheet, the intended effects of the present invention are enhanced. More specifically, a sterilizing gas or high pressure steam is allowed to freely come in and out through the fiber layer interposed in the sealing section, and since the fiber layer includes discontinuous portions formed by melting of the resin, the intrusion of germs after sterilization is effectively prevented. For the same reason as described above, the density of the fibrous sheet should be not more than 0.7 g/cm$^3$.

In this embodiment, a medical applicance is inserted in the zone of the fold former, and simultaneously or subsequently, side seals are formed and top seals are then formed. Then, cutting is conducted between the top seals, and bags containing medical appliances packed therein are continuously withdrawn one by one.

In view of high pressure steam sterilization conditions now adopted in the art, the materials used in the present invention, such as plastic films, thermoplastic resins, synthetic pulps, thermoplastic fibers, papers and non-woven fabrics should have such properties that when they are formed into bags, contraction, blocking or melting is not caused at temperatures lower than 135° C. General-purpose materials such as polyesters, polycarbonates, polypropylene and nylon resins are suitable as materials meeting the above requirement, but polyethylene and vinyl chloride polymer resins ordinarily used for automatic packing are not preferred.

Medical appliances to be packed are inserted at predetermined intervals by a feed conveyor or a metering dropping apparatus or according to detection by a phototube.

According to need, a printer for printing dates or kinds of packed medical appliances, a device for detecting the abnormal state of a packed appliance and a counter may be attached to the automatic packing apparatus that is used for carrying out the process of the present invention. Furthermore, a sterilizing lamp may be attached.

When the thus packed medical appliances are sterilized under high pressure steam sterization conditions or EOG sterilization conditions specified in the Japanese Pharmacopeia, it has been confirmed by biological sterilization indicators attached to the appliances in advance that the packed appliances can be completely sterilized. Furthermore, by the sterile culturing test, it has been confirmed that the germ-free state can be maintained for more than 6 months.

By selecting specific packing sheets according to the present invention, it becomes possible to perform automatic packing of medical appliances to be sterilized in a continuous manner in hospitals and the like. Furthermore, in the process of the present invention, the packing speed can be increased to a level about 4 times as high as the packing speed in the conventional manual packing method. Still further, since the packing operation is conducted consistently in a continuous manner, medical appliances and packing sheets are hardly touched by hands and thus the risk of contamination or breakage is reduced. Moreover, since packing sheets are in the form of long rolls, storage and maintenance of sterilizing bags can be remarkably facilitated.

What is claimed as new and desired to be secured by Letters Patent of the United States is:

1. An apparatus for continuously packing medical appliances for sterilization, comprising:

means for delivering said appliances to said apparatus along a packing path in a packing direction;

means for supplying continuous packing sheets to said apparatus in said packing direction;

means for enclosing each of said appliances between two of said packing sheets;

means for sealing first edges of said packing sheets which are lateral to said packing direction;

means for sealing said packing sheets at sealing portions between said appliances in said packing direction;

means for cutting said sealed sheets at said sealing portions so as to form individual packets, wherein said means for enclosing comprise:

a cylinder having a longitudinal axis extending along said packing path in said packing direction;

a pair of longitudinal first slits in said cylinder, said slits extending along said packing direction and dividing said cylinder into two semi-cylinder portions which are symmetric about a plane defined by said slits; and guide means fixed to each of said semi-cylinder portions at one axial end thereof, said guide means being separated by second slits coplanar with said first slits, whereby said means for supplying packing sheets supply one of said packing sheets to be turned over each of said guide means and passed through said first and second slits, wherein said guide means are each symmetric about said plane and each include a semiconical guide portion, each said guide portion extending axially from a respective said semi-cylinder portion and being angled from said feed direction by between 5° and 90°, wherein each of said guide means include flat extending portions confronting one another on either side of said plane and extending outward from said semi-cylinder portions in a radial direction, said second slits being equal in width to said first slits and comprising spaces between said flat extending portions.

2. The apparatus of claim 1 wherein each of said guide means include flat extending portions confronting one another on either side of said plane and extending outward from said semi-cylinder portions in a radial direction, said second slits being equal to said first slits and comprising spaces between said flat extending portions.

3. The apparatus of claim 2 wherein said semi-conical guide portions together approximate a truncated cone having a cylindrical truncated end.

* * * * *